US006026952A

United States Patent [19]

Brooks

[11] Patent Number: 6,026,952

[45] Date of Patent: Feb. 22, 2000

[54] LIQUOR AND CIGAR COMBINATION PACK

[76] Inventor: William Brooks, 35W337 Riverside Dr., St. Charles, Ill. 60174

[21] Appl. No.: 09/286,049

[22] Filed: Apr. 5, 1999

[51] Int. Cl.[7] ..... B65D 77/00

[52] U.S. Cl. ..... 206/216

[58] Field of Search ..... 206/216, 541, 206/542, 86, 242; 426/106, 120

[56] References Cited

U.S. PATENT DOCUMENTS 4,308,952 1/1982 Paulucci ..... 206/216

5,372,827 12/1994 Brauner et al. ..... 206/216 X 5,664,671 9/1997 Nedblake, Jr. ..... 206/541

*Primary Examiner*—Jacob K. Ackun

*Attorney, Agent, or Firm*—Wood, Phillips, VanSanten, Clark & Mortimer

[57] ABSTRACT

A beverage and tobacco combination package is provided including a preselected amount of a beverage provided in a first container and a tobacco product in a second container separate from the first container. The preselected amount of the beverage in the first container and the tobacco product in the second container are preferably packaged together in a third container separate from the first and second containers and sold as a single item.

14 Claims, 1 Drawing Sheet

Figure
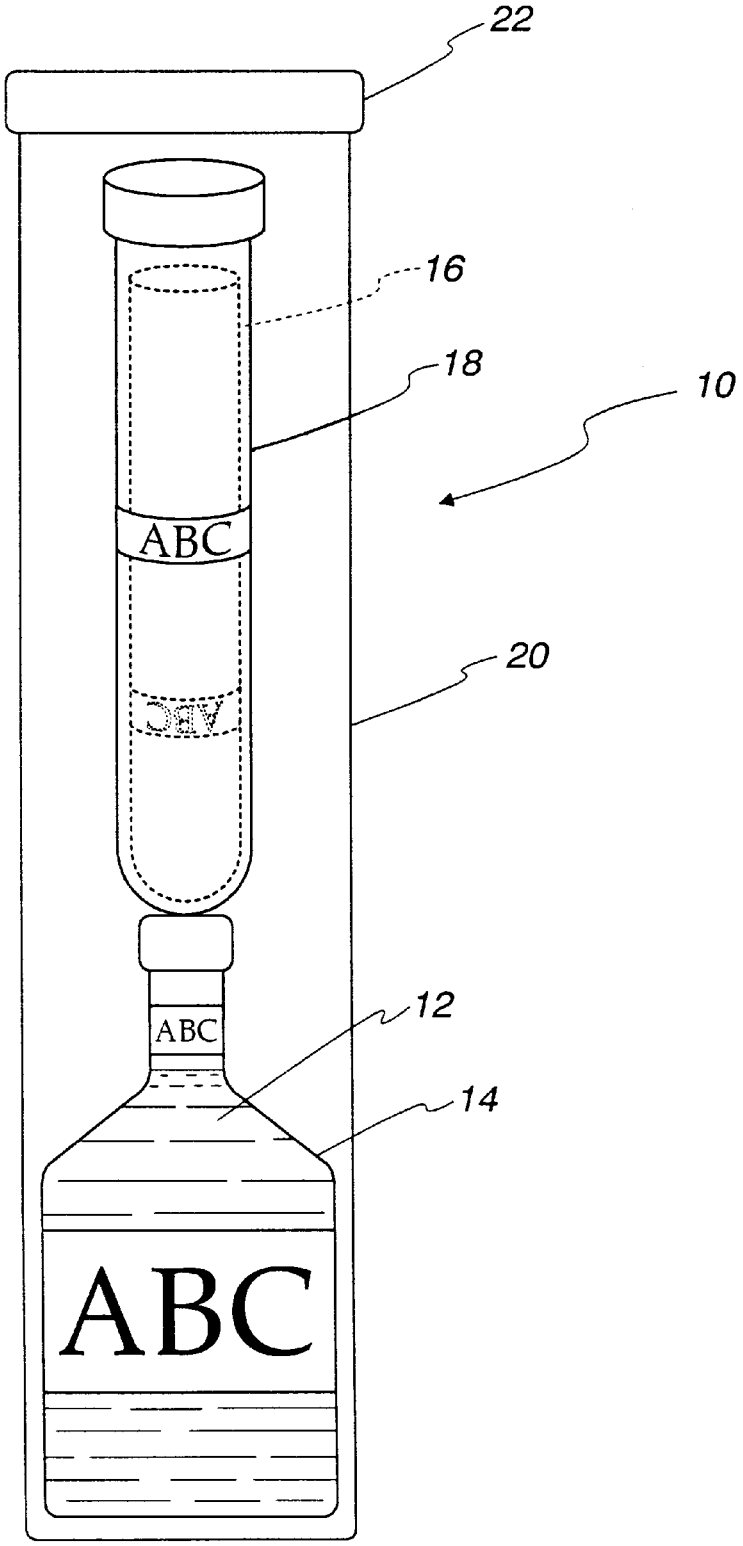

LIQUOR AND CIGAR COMBINATION PACK

FIELD OF THE INVENTION

The present invention is directed toward a beverage and tobacco combination pack and, more particularly, toward a liquor and cigar combination pack.

BACKGROUND OF THE INVENTION

Cigar smoking is becoming a popular past time, typically among the male population. Generally, in association with enjoying a fine cigar, one will also enjoy his/her favorite beverage, preferably an alcoholic beverage. Thus, many taverns and other establishments selling liquor also provide for sale to their patrons an assortment of cigars, sold entirely separately from the liquor, in various flavors and sizes.

Cigars may generally be purchased one at a time or in boxes, with approximately 20–50 cigars to a box. Liquor is typically purchased, aside from individual drinks purchased at a tavern or restaurant (so-called "on sale" liquor sales), at a liquor store in quantities ranging from pints, to fifths, to liters (so-called "off sale" liquor sales). Thus, a person wishing to enjoy a cigar with a certain type of alcoholic beverage must first purchase a particular cigar(s), and then possibly travel to a different location, assuming they are not at a location selling both cigars and liquor, and purchase a quantity of the alcoholic beverage of their choice. Further, a person desiring to purchase a gift for an avid cigar smoker must purchase the cigar and the liquor separately. In this case, since the liquor will most likely be purchased at a liquor store, the purchaser may be required to travel to different locations to purchase both items. Still further, a purchaser of these items may purchase either too many cigars or too much liquor, resulting in wasted money.

The present invention is directed toward overcoming one or more of the above-mentioned problems.

SUMMARY OF THE INVENTION

A beverage and tobacco combination pack is provided including a preselect amount of a beverage provided in a first container and a tobacco product. The preselect amount of the beverage in the first container and the tobacco product are preferably packaged together in a second container separate from the first container and sold as a single item.

In one form, the beverage includes an alcoholic beverage, preferably a liquor, such as, brandy, bourbon, cognac, whiskey, gin, rum, vodka, etc.

The alcoholic beverage may simply be a small bottle of liquor ranging in size from 20–100 mL, with 50 mL being the contemplated preferred volume of liquor.

In another form, the tobacco product is a cigar or cigarette. The cigar or cigarette may be related to the alcoholic beverage. The cigar or cigarette may be of the same make as the alcoholic beverage, may be a private label cigar/cigarette for the maker of the alcoholic beverage, or may actually be soaked in the alcoholic beverage during manufacture thereof.

The cigar or cigarette may be contained in an airtight third container separate from the first and second containers.

The invention permits a purchaser, or user, thereof to simply add ice and/or a mixer to the alcoholic beverage and enjoy a cigar with their drink without the hassle of having to purchase the two separately, typically at different locations.

It is an object of the present invention to provide a convenient packaging arrangement featuring alcohol and tobacco products.

Other aspects, objects and advantages of the present invention can be obtained from a study of the application, the drawings, and the appended claims.

BRIEF DESCRIPTION OF THE DRAWINGS

The FIGURE is a front view of a liquor and cigar combination pack according to the present invention.

DETAILED DESCRIPTION OF THE INVENTION

The FIGURE illustrates a combination package arrangement according to the present invention, shown generally at 10. The combination package 10 includes a preselect amount of a beverage 12 provided in a first or beverage container 14. In a preferred form, the beverage 12 is an alcoholic beverage, such as liquor, e.g., brandy, bourbon, cognac, whiskey, gin, rum, vodka, etc. However, virtually any type of beverage, both alcoholic and non-alcoholic, may be implemented with the present invention without departing from the spirit and scope thereof. The beverage container 14 may be a bottle, or other container, with approximately 20–100 mL of the beverage 12 provided therein. A 50 mL bottle of liquor is the preferred choice. In one embodiment a conventional "miniature" is employed.

The combination package 10 also includes at least one cigar 16, provided in a second or tobacco container 18. Virtually any size cigar 16 may be implemented with the tobacco container 18 sized to fit the cigar 16. The containers 14 (including the beverage 12) and 18 (including the cigar 16) are packaged together in a third container 20 which is separate from either of the beverage or tobacco containers 14 and 18. The third container 20 is preferably a clear cylindrical plastic container approximately 12"14" in length and approximately 1¼" to 1¾" in diameter, and having a lid 22 which may be either snap fit or twist off.

As shown in the FIGURE, the beverage container 14 and cigar container 18 are stacked one on top of each other to fit end to end inside the container 20, which is sized accordingly. However, any packaging arrangement, side-by-side, etc., in any type of third container 20, size or material, may be implemented without departing from the spirit and scope of the present invention. For example, the cylindrical third container 20 illustrated in the FIGURE may be replaced by a box-type container, shrinkwrap material enclosing the items, etc. Further, the container 20 need not be transparent. In some cases, the second container 18 may be sized to receive both the cigar 16 and the first container 14 and then sealed. In this case, the third container 20 may be eliminated entirely.

To preserve the freshness of the cigar 16, the container 18 is preferably airtight. Virtually any type of cigar 16 may be packaged with virtually any type of beverage 12. For example, a Speakeasy™ brand cigar may be provided with any type of liquor, e.g., brandy, bourbon, cognac, whiskey, gin, rum, vodka, etc. However, in a preferred form, both the cigar 16 and the beverage 12 are related. As shown in the FIGURE, both the cigar 16 and the beverage 12 are of the same brand, e.g., "ABC" brand. However, the cigar 16 may be a private label cigar made for the beverage manufacturer whose beverage is included in the packaging arrangement 10. In any event, the cigar 16 and containers 18 and 14 would preferably include the same labels, with the container 18 preferably having an appearance somewhat similar to the appearance of the bottle 14. However, the cigar 16 may be totally unrelated to the beverage 12, e.g., made by different companies or sold under different brands.

Further, the cigar 16 may be related to the beverage 12 such that during manufacture the cigar 16 is soaked in the beverage 12, relating the flavor of the cigar 16 to that of the beverage 12. For example, if the beverage 12 consisted of ABC bourbon, the cigar 16 may be of the type that is soaked in ABC bourbon.

While the FIGURE illustrates a cigar 16 packaged with the beverage 12, other tobacco products may be substituted in place of the cigar 16 without departing from the spirit and scope of the present invention. Such products may include one or more cigarettes, pipe tobacco, etc. If pipe tobacco is provided, a pipe (not shown) may be included within the combination package 10 as part of the tobacco product.

The inventive combination package 10 provides a user with a simple and economical means of enjoying a cigar with a drink, without wasting time and money purchasing the two separately, often at two different locations. A user may simply add ice and/or a mixer to the beverage (liquor) 12, if they so desire, and enjoy the cigar 16 with his/her drink.

While the invention has been described with particular reference to the drawings, it should be understood that various modifications could be made without departing from the spirit and scope of the present invention.

I claim:

1. In combination:

a preselected amount of a beverage provided in a beverage container; and a tobacco product, wherein the preselected amount of the beverage in the beverage container and the tobacco product are packaged together in an additional container separate from the beverage container.

2. The combination of claim 1, wherein the beverage includes an alcoholic beverage.

3. The combination of claim 2, wherein the alcoholic beverage includes a liquor.

4. The combination of claim 3, wherein the preselected amount of liquor provided in the beverage container ranges from 20–100 mL of liquor.

5. The combination of claim 1, wherein the tobacco product includes at least one cigar or cigarette.

6. The combination of claim 5, wherein the at least one cigar or cigarette is related to the beverage provided in the beverage container.

7. The combination of claim 6, wherein the at least one cigar or cigarette is soaked in a beverage that is the same as the beverage provided in the beverage container during the manufacture of the at least one cigar or cigarette.

8. The combination of claim 5, wherein the at least one cigar or cigarette is contained in an air tight tobacco container separate from the beverage and additional containers.

9. In combination:

a preselected amount of an alcoholic beverage provided in a first container; and at least one cigar or cigarette, wherein the preselected amount of the alcoholic beverage in the first container and the at least one cigar or cigarette are packaged together in a second container separate from the first container.

10. The combination of claim 9, wherein the at least one cigar or cigarette is contained in an air tight third container separate from the first and second containers.

11. In combination:

a 20–100 mL bottle of an alcoholic beverage;

at least one cigar or cigarette; and a sealed container housing both said bottle and said at least one cigar or cigarette.

12. The combination of claim 11, wherein the at least one cigar or cigarette is contained in an air tight tobacco container separate from the sealed container.

13. The combination of claim 11, wherein said bottle and said at least one cigar or cigarette are located in end to end relation in said sealed container.

14. The combination of claim 13, wherein said sealed container is cylindrical.

* * * * *